United States Patent [19]

Barron, Sr.

[11] 4,053,288

[45] Oct. 11, 1977

[54] HAND FED GLASS BEVELING APPARATUS

[76] Inventor: Lee H. Barron, Sr., 4515 Alta Canyada Road, La Canada, Calif. 91011

[21] Appl. No.: 672,029

[22] Filed: Mar. 30, 1976

[51] Int. Cl.[2] ..... B24B 9/10; B24B 41/06

[52] U.S. Cl. ..... 51/109 R; 51/128; 51/240 GB

[58] Field of Search ..... 51/109, 110, 128, 240 GB, 51/263, 267, 272; 269/286, 296, 303, 317; 193/1, 38, 41

[56] References Cited

U.S. PATENT DOCUMENTS

| | | | |
|---|---|---|---|
| 945,455 | 1/1910 | Hanson | 51/109 R |
| 1,328,242 | 1/1920 | Farley | 51/128 X |
| 1,848,470 | 3/1932 | Fohrenbach | 51/110 |
| 2,551,332 | 5/1951 | Moore | 51/110 |
| 2,578,789 | 12/1951 | Donnelly | 51/110 |
| 2,741,073 | 4/1956 | Schwabe | 51/128 |
| 3,172,831 | 3/1965 | Williams | 51/272 X |
| 3,638,366 | 2/1972 | Gamache | 51/267 X |
| 3,841,027 | 10/1974 | Bando | 51/110 |
| 3,935,679 | 2/1976 | Peter | 269/296 |

*Primary Examiner*—James L. Jones, Jr.
*Assistant Examiner*—Nicholas P. Godici
*Attorney, Agent, or Firm*—Hill, Gross, Simpson, Van Santen, Steadman, Chiara & Simpson

[57] ABSTRACT

A hand fed glass beveling apparatus comprises table means for slidably supporting a hand manipulated glass piece to be beveled under a grinding and polishing head including a spindle selectively carrying a grinding wheel or a polishing wheel and driven by a motor on a mount permitting adjustments for incremental variations in width of bevel. An edge gauging stop is carried by the table means under the head. Selectively, dual streams of coolant water or polishing solution are directed to the working surface of the wheel under a splash guard hood. The table means include spaced limited contact knobs which facilitate maneuvering the glass piece relative to the wheel.

28 Claims, 6 Drawing Figures

57
49
55
51
58
53
45
83
54
32
25
50
30
35
98
87
98
87
17
18
11
21
91
85
12
20
20
20
24
20
II
II
13
15
14
95
77
75
97
10
81
82
79
78
83
80
21
24
20
23
22
13
19

11
10
17
18
24
28
29
IV
13
14
15
20
21
27
32
33
34
35
37
38
39
40
41
45
47
48
49
50
54
59
69
70
71
85
87
90
94

HAND FED GLASS BEVELING APPARATUS

This invention relates to new and improved hand fed glass beveling apparatus.

Although the art of beveling glass is fairly old, and sophisticated machines have been developed to facilitate mass production beveling, the needs of those engaged in custom beveling small quantities or individual glass pieces have not been satisfactorily met. That need is especially catered to by the present invention.

An important object of the present invention is to provide a simple, low cost, efficient hand fed glass beveling machine providing for great versatility as to depth and angle of bevel and in the accomodation to variably contoured glass piece edges.

Another object of the invention is to provide new and improved hand fed glass beveling apparatus which is compact, simple to set up, easy to operate, and efficient in performance.

A further object of the invention is to provide a new and improved low cost hand fed glass beveling apparatus capable of results previously generally requiring more complex, costly, larger and less versatile apparatus.

According to features of the invention, there is provided a hand fed glass beveling apparatus comprising table means for slidably supporting a hand manipulated substantially flat glass piece to be beveled, a rotary spindle having means at one end for rotatively selectively supporting a bevel grinding or polishing wheel having a bevel-working surface, means for driving the spindle rotatably, means supporting the spindle and driving means above the table means with the wheel-supporting end adjacent to the table for positioning the supported wheel with its bevel-working surface oriented to work on an edge of the glass slidably manipulated on the table means toward the working surface, and gauging stop means mounted on the table means for properly stopping infeed of the glass piece edge relative to the working surface. Easy and convenient wheel change and bevel width adjustments are enabled. Coolant and polishing solutions are efficiently supplied and confined to the grinding and polishing operating zone. While efficiently supporting the glass piece to be beveled, the table means enables convenient positive manipulation of the glass piece by supporting the piece effectively at a plurality of substantially spaced points, thereby facilitating maneuvering of the piece relative to the grinding or polishing wheel.

Other object, features and advantages of the invention will be readily apparent from the following description of certain representative embodiments thereof, taken in conjunction with the accompanying drawings although variations and modifications may be effected without departing from the spirit and scope of the novel concepts embodied in the disclosure, and in which.

Figures 1, 2:
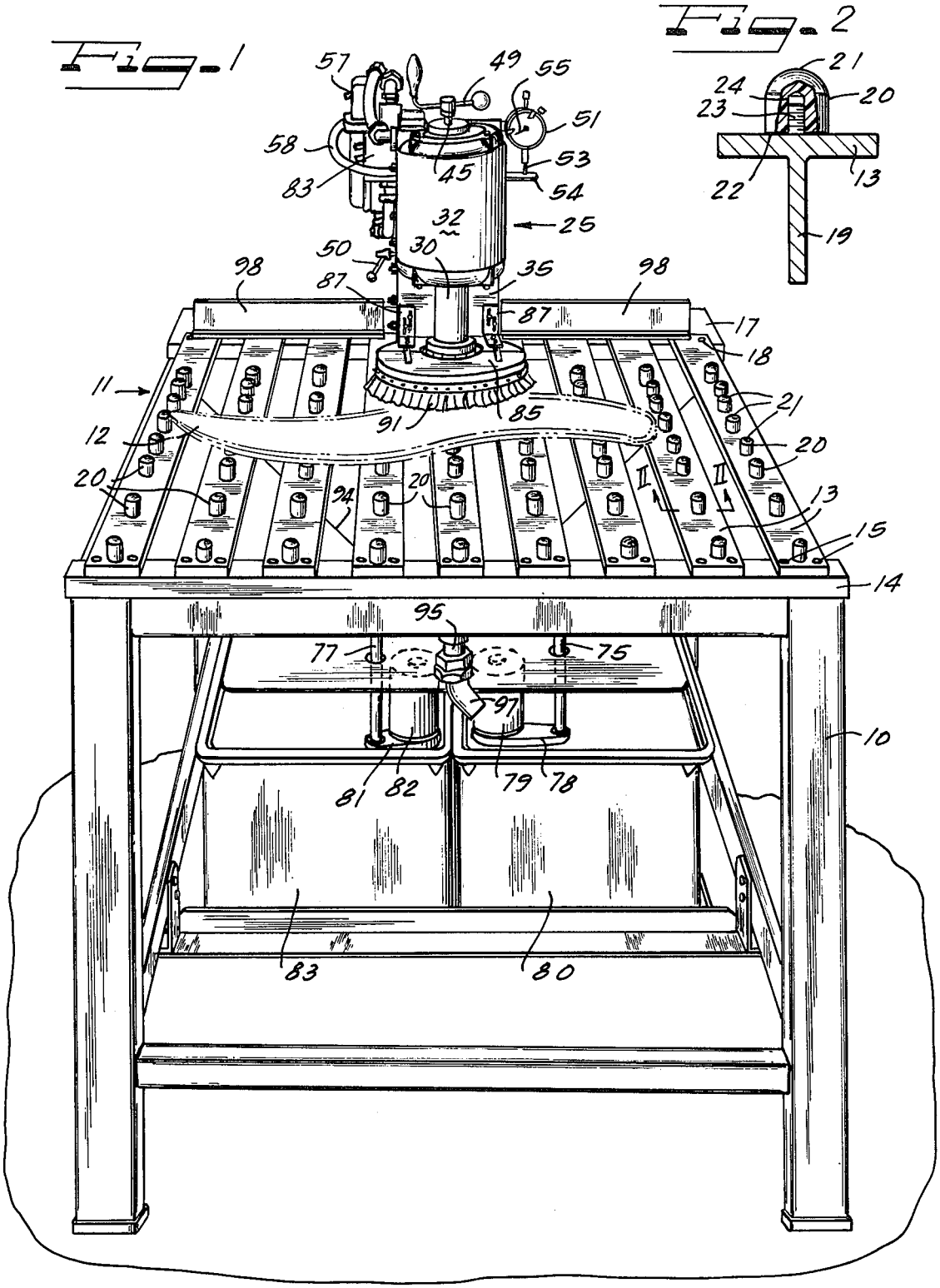
FIG. 1 is a perspective view of apparatus embodying features of the invention.
FIG. 2 is an enlarged fragmentary vertical sectional detail view taken substantially along the line II—II of FIG. 1.

On reference to FIG. 1, apparatus embodying features of the invention comprises a suitable stand 10 desirably comprising welded frame structure supporting table means 11 at a convenient working height for slidably supporting a hand manipulated substantially flat glass piece 12 to be beveled. In a preferred construction, the table means 11 comprise a plurality of front to rear bars 13 supported in coplanar substantially horizontal spaced parallel relation on top of the frame 10. At their front ends, the bars 13 are supported on a transverse frame beam 14 to which they may be secured as by means of screws 15. At their rear ends, the table bars 13 are supported on a frame bar 17 to which they may be secured as by means of screws 18. In a preferred construction which is of minimum weight but maximum resistance against downward deflection, the bars 13 are of generally T-shape section with depending longitudinal central reinforcing ribs 19.

Figure 3:
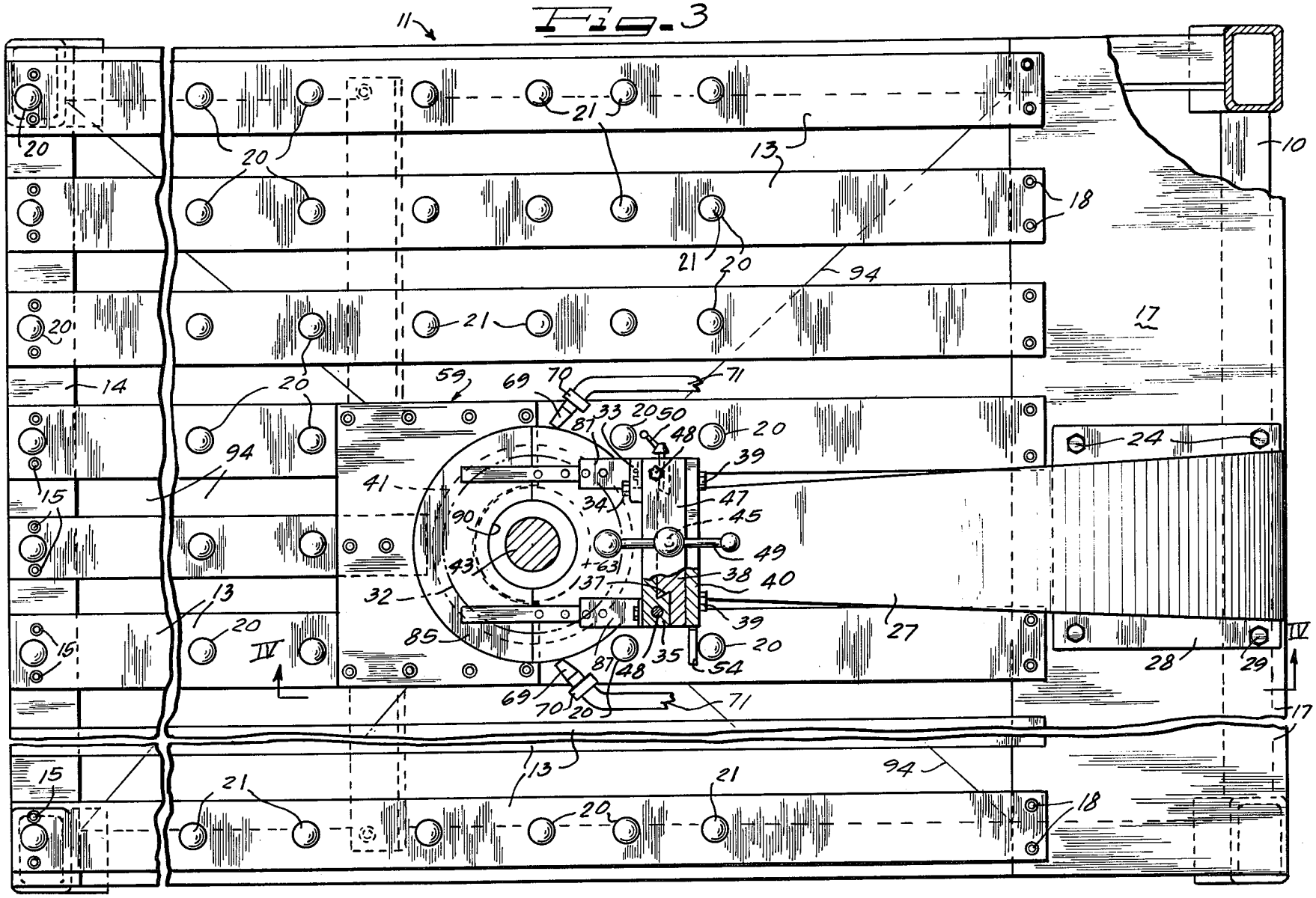
FIG. 3 is a top plan fragmental view of the apparatus with certain parts broken away and in section to facilitate better standing of the structure.

Means in the form of upwardly projecting spacer knobs 20 are carried by the bars 13 to provide a glass supporting table surface on which the glass piece 12 will have minimum frictional engagement so as to be easily slidably manipulated over the table, and in addition to enable thorough manipulative grasping and maneuvering of the glass piece. To this end, the spacer knobs 20 are desirably formed from a suitable low friction material such as nylon. All of the knobs 20 are preferably of a standarized form and of equal height, each having a convex crown 21 (FIG. 2) whereby substantially only point contact is made with the engaged surface of the glass piece 12. On their lower ends, each of the knobs 20 has a flat base surface 22 which engages the flat top surface of the associated bar 13. Fastening of the knobs 20 to the bars 13 may be effected by equipping the bars with upwardly projecting threaded studs 23 at the intervals to receive the knobs 20 and to which studs the knobs are threadedly secured by threading the upwardly projecting studs into complementary respective downwardly opening sockets 24 therein. As best visualized in FIGS. 1 and 3, the knobs 20 are disposed in spaced relation in rows along each of the table bars 13 and aligned in rows across the table.

For beveled grinding and polishing the glass piece 12 as manipulated on the work table, means are provided in the form of a head 25 desirably supported in overhanging relation to the table by means of a generally gooseneck shaped mounting pedestal 27 (FIGS. 3 and 4) having a base 28 carried by and secured to the rear frame beam 17 as by means of screws 29. From the frame beam 17 the pedestal 27 projects upwardly and forwardly to support the head 25 in preferably substantially centered relation over the table 11.

As a principal component, the head 25 comprises a rotary spindle 30 (FIGS. 4 and 5) in the form of an adapter keyed to and secured to a depending motor shaft 31 of an electrical drive motor 32 having along its rear side a vertical mounting base plate 33 (FIGS. 3 and 4) secured as by means of bolts 34 to a slide 35 having a vertical dovetail groove gibway 37 in slidable engagement with a gib 38 secured as by means of bolts 39 to a vertical head plate 40 located rigidly on the head of the pedestal 27 which overhangs the table 11.

On its lower end, the spindle 30 has means for rotatably selectively supporting a bevel grinding or polishing wheel 41 having a bevel-working surface 42. For quick change of grinding and polishing wheels, each of the wheels is carried by suitable tapered stem 43 adapted to be releasably coupled operatively with the spindle 30 as by means of a collet 44. In the course of a beveling operation, three different ones of the wheels 41 may be employed such as a first or roughing wheel having at least the bevel-working surface 42 provided with 180 grit diamond to provide a fast cutting surface, followed by a second wheel with the surface 42 provided with 400 grit diamond, whereafter a third wheel with a felt polishing surface 42 is employed.

To facilitate changing of the grinding and polishing wheels 41, and to enable operating adjustments to be made for controlling the width of bevel to be formed on any particular glass piece, the grinding and polishing head 25 is vertically shiftable and adjustable. For this purpose a vertical adjusting screw 45 (FIGS. 3 and 4) is carried by a header bar 47 secured as by means of bolts 48 to the upper end of the slide 35. The screw 45 is threaded into a complementary upwardly opening threaded bore 45*a* in the gib plate 38. On its upper end, the screw 45 has an operating crank 49. By operating the crank 40 to turn the screw 45, the head 25 can be raised and lowered as desired, for example, between the raised full line position shown in FIG. 4 and lowered dash outline position shown in FIG. 4 and in full line FIGS. 1 and 5. The preferred adjusted vertical position of the head 25 may be maintained by means of a locking device including a lever 50 (FIGS. 1 and 3) whereby the slide 35 and the gib plate 38 are releasably locked immovably until the lever 50 is actuated to release the lock. Means for gauging incremental infeed during grinding operation may comprise a dial indicator (FIG. 1) mounted fixedly as by means of a bracket 52 (FIGS. 4) on the header bar 47. An actuator plunger 53 depending from the dial 51 is engageable with a stop 54 which may be mounted on the side of the mounting plate 40 so that in the grinding and polishing orientation of the head 25, the dial 51 will register by means of a needle 55 the incremental position of the grinding or polishing wheel. The face of the dial 51 may be calibrated in increments of 1 thousandth of an inch. A suitable on-off electrical switch 57 for controlling the motor 32 through a suitable electrical lead 58 may be mounted above the rear portion of the table adjacent to the pedestal 27.

Figure 4:
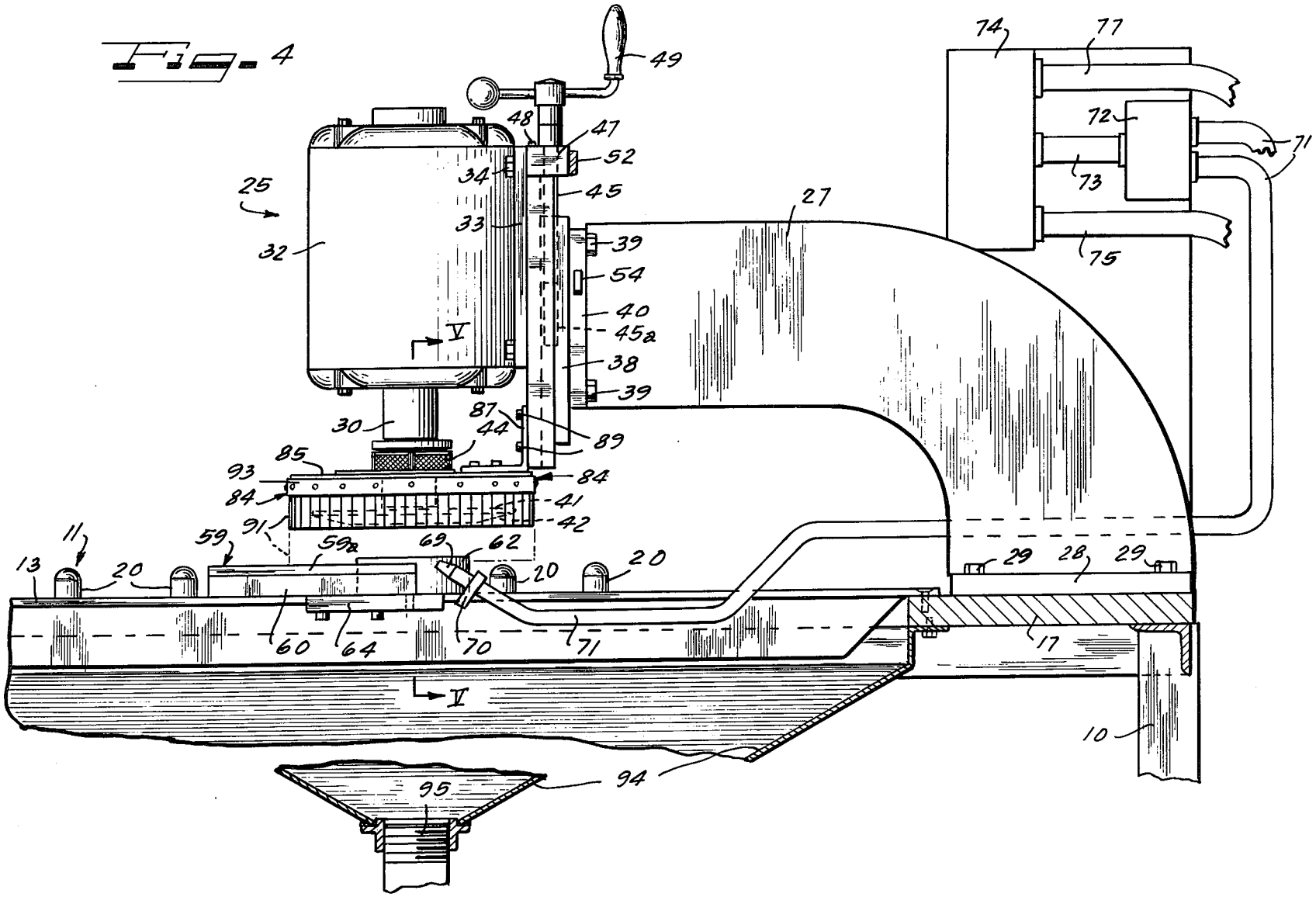
FIG. 4 is a vertical sectional fragmentary detail view taken substantially along the line IV—IV of FIG. 3.
Figure 5:
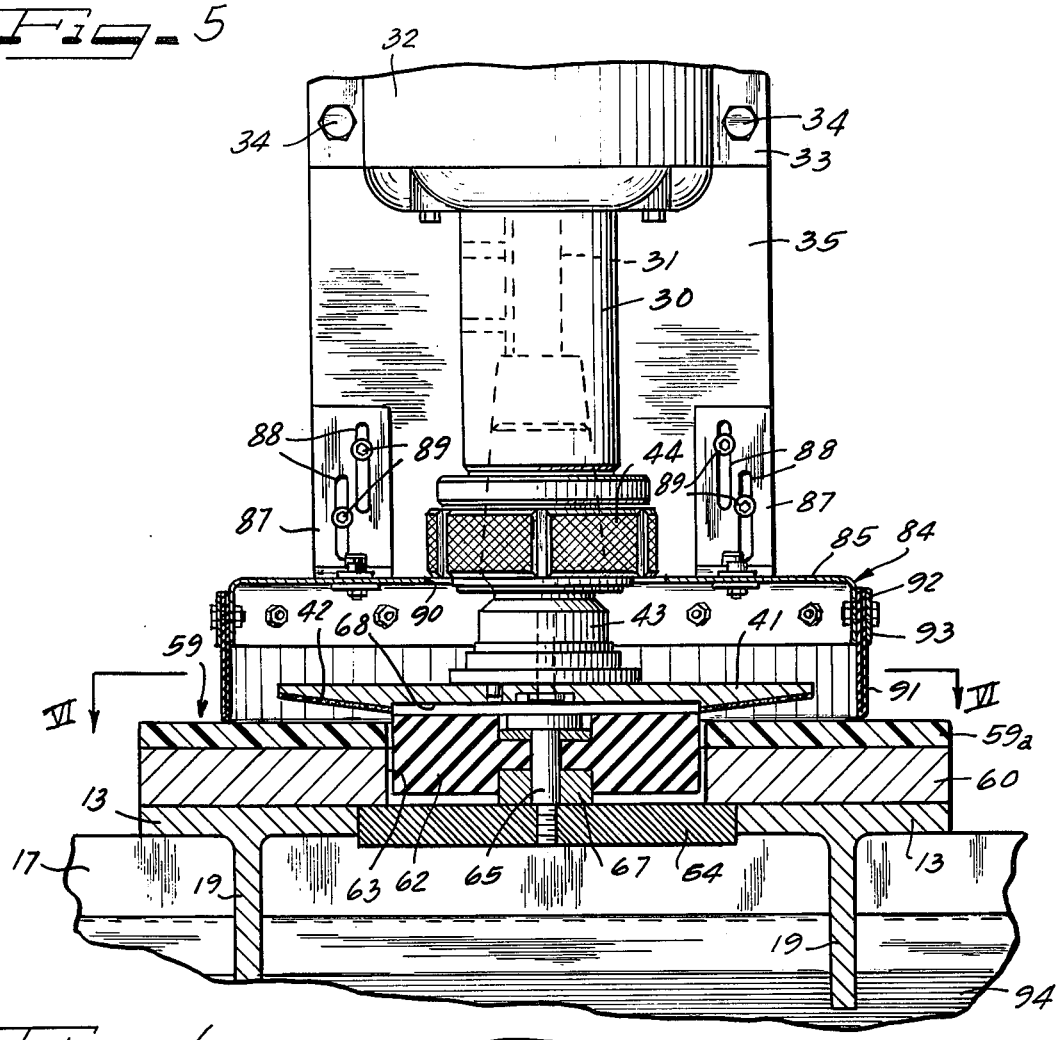
FIG. 5 is an enlarged fragmentary sectional elevational view taken substantially along the line V—V of FIG. 4.
Figure 6:
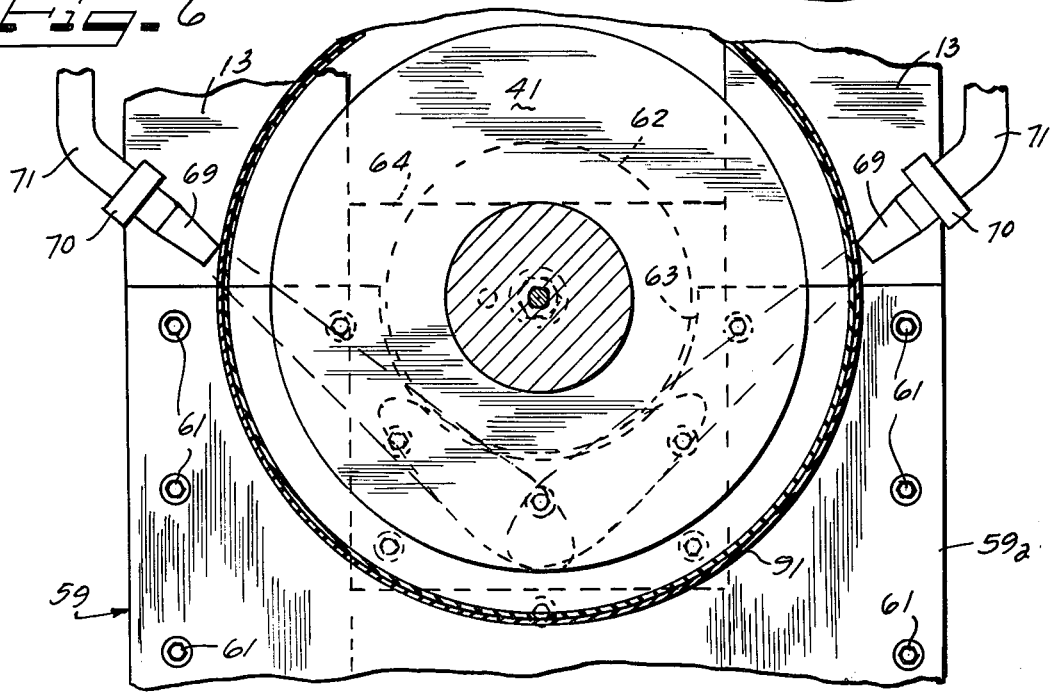
FIG. 6 is a fragmentary sectional plan view taken substantially along the line VI—VI of FIG. 5.

At the beginning of a grinding operation, the wheel 41 in the form of a roughing wheel is mounted on the spindle 30 while the head 25 is in the raised position as shown in full line in FIG. 4. The head 25 is then lowered to the grinding position by manipulating the handle 49 while the lock 50 is released and until the working surface 42 of the wheel is at the proper position as determined by the gauge 51 to produce the desired width of bevel on the glass piece 12. The lock 50 is then locked to hold the head in the adjusted position until the rough grinding has been completed. After the rough grinding has been completed, the lock 50 is again released, the head 25 raised, and a finish grinding wheel is substituted by means of the quick change collet 44. Lowering and resetting of the head 25 is repeated, and finish grinding effected. On completion of the finish grinding, the head is again raised and a felt polishing wheel is substituted, the head then being again lowered to the adjusted position and the bevel on the glass piece 12 polished. By means of the control switch 57, the motor 32 is turned on and off as required. During each grinding and polishing pass, the glass piece 2 is manually manipulated toward the wheel 41 and linearly moved to present its curvilinear edge progressively to the working surface 42 as the grinding or polishing progresses.

For utmost control of the glass piece 12, a solid flat upwardly facing table area 59 (FIGS.3-6) is provided substantially centrally in the grinding zone of the table means 11, desirably comprising anti-friction means such as a nylon facing panel 59*a*secured on a metal base piece 60 as by means of countersunk screws 61 and which also secure the assembly to the underlying supporting table bars 13. It will be understood, of course, that the top of the solid table area 59 is offset upwardly relative to the lower elevation area of the table bars 13, and is coplanar with the crown tips 21 of the array of supporting knobs 20. By having the axis of the wheel 41 normal to the supporting plane of the support tips 21 and the table area 59' and generally aligned over the flat table area 59, the width of the bevel to be formed on the glass piece is readily determined by controlling the width of the marginal area of the glass piece presented to the generally downwardly facing beveled working surface 42 of the wheel.

Movement of the edge of the glass piece 12 toward the working surface 42 of the wheel 41, after a bevel of the desired width has been completed on the edge, is stopped by locater or gauging stop means contiguous to an edge of the offset table area 59 and desirably comprising a rotary disk 62 (FIGS. 5 and 6) of suitable substantial thickness and has at least its glass engageable perimeter edge formed from a suitable elastomer. The disk 62 is mounted rotatably coaxially under the wheel 41 in a complementary recess 63 in the table area 59 across the bottom of which is fixedly secured a base plate 64 carrying a fixed axle 65 about which the disk 62 is freely rotatably journaled. The disk 62 may ride on a spacer thrust bearing washer 67 which rests on the base plate 64, and may be reversible. As mounted in its operating position, the stop disk 62 projects sufficiently above the upper plane of the surface area 59 to expose its perimeter edge to receive the edge of the glass piece 12 for stopping infeed of the glass piece edge relative to the working surface 42 especially after the desired bevel width has been attained. To this end the diameter of the disk 62 is properly corelated to the inside diameter of the bevel 42, and the bottom of the wheel 41 is provided with a complementary clearance recess 68 into which the working head portion of the disk 62 is adapted to be received freely.

Dual means are provided for applying coolant to the grinding area of the beveled working surface 42 of the respective grinding wheel and polishing solution to the corresponding working surface of the polishing wheel. In a preferred construction and in order to apply the respective solutions to substantially the entire chordal area of the working surface 42 toward which the glass piece 12 may be manipulated during a grinding or polishing operation, a pair of nozzles 69 (FIG. 6) is mounted as by means of clips or brackets 70 on the table bars 13 which support the structure of the table area 59, and with the nozzles 69 directed from beneath the wheel 41 convergently toward the front chordal portion of the working surface 42. Each of the nozzles 69 comprises part of or at least is connected to a respective supply duct 71 connected at the rear of the apparatus to a manifold 72 through which the solution is substantially equally distributed to the ducts 71 as received from a pipe 73 communicating with a suitable valve assembly 74 such as a conventional 3-way valve by which either coolant water is supplied from a conduit 75 to the ducts 71 or polishing solution containing cerium oxide is supplied to the ducts from a conduit 77. The valve assembly 74 may be of the pressure sensitive reversible type. Coolant water is supplied to the conduit 75 by means such as a centrifugal pump 78 (FIG. 1) driven by a motor 79 and immersed in a water tank 80 supported by the frame 10 under the table 11. Similarly, polishing solution is supplied to the conduit 77 by means of a centrifugal pump 81 driven by motor 82 and immersed in a polishing solution tank 83 carried by the frame 10 under the table 11 alongside the tank 80. During grinding operations the coolant pump motor 79 is operated and the polishing solution pump motor 82 is inactivated. On the other hand during polishing operations the polishing solution pump motor 82 is activated and the coolant solution pump motor 79 is inactivated. This is conveniently effected by electrical switch means 83 which may be mounted adjacent to the grinding and polishing head motor control switch 57. Through this arrangement, both of the nozzles 69 will simultaneously project, selectively, either coolant water or polishing solution streams to the working surface 42 of the wheel 41.

Splash guard hood means 84 are provided over the grinding-polishing area about the wheel 41. In a convenient form, the splash guard 84 comprises a generally inadverted pan shaped head 85 mounted by means of brackets 87 on a suitable depending portion of the mounting plate 35. Vertical adjustments of the splash guard 84 may be effected by means of vertical slots 88 in the brackets for attachment screws 89 by which the brackets are secured in adjusted position on the lower end portion of the plate 35. Clearance for the collet 44 is provided by an aperture 90 in the central portion of the guard head 85. To permit freedom of movement of the glass piece 12 under the splash guard 84, a depending flexible segmented curtain 91 is provided about the perimeter of the head 85. In a suitable construction, the curtain 91 comprises a folded strip 92 of suitable plastic material such as neoprene secured to the perimeter of the head 85 as by means of a retaining band 93 and with the depending portion of the curtain slit vertically along numerous depending segments in contiguous edge-to-edge relation. Adjustment of the splash guard 84 is such that the lower edge of the curtain 91 at least closely approaches the table area 59, and the length of the curtain is ample to permit free maneuvering of the glass piece 12 relative to the wheel 41 under the splash guard 84 while attaining maximum splash protection in operation.

Spent coolant or polishing fluid, as the case may be, drops down through the slotted lattice of the spaced table bars 13 into a collection pan 94 secured under the table 11 and converging downwardly toward a central drain 95 (FIGS. 1 and 4) which overlies the contiguous sides of the tanks 80 and 83 and carries on its lower end a swiveled oblique drain nozzle 97 which is adapted to be manually turned to discharge into either of the tanks 80 or 83 selectively so that during coolant water requirements the coolant water will be discharged from the nozzle 97 into the tank 80 for recirculation, and during polishing the polishing solution will be discharged from the nozzle 97 into the tank 83 for recirculation.

From the foregoing, it will be apparent that any desired curvilinear contour on the glass piece 12 may be beveled by manual manipulation, and the particular curvilinear shape shown for the glass piece 12 in FIG. 1 will be understood to be merely by way of example. Should there be a requirement for straight edge beveling, suitable straight edge guide means may be utilized conveniently comprising one or more straight edge guide bars 98 which are shown in FIG. 1 as in an out of the way position on the rear frame bar 17, when curvilinear edge beveling is to be effected. When a straight edge bevel is to be ground and polished, the straight edge guides 98 are placed in position transversely across the table 11 between suitable ones of the table studs 20, with the straight edges of the guides suitably aligned with the working surface 42 of the wheel 41. In a satisfactory form, the straight edge guides 98 may comprise bars of L-shape section with one flange serving as a base of a width to fit conveniently between the selected knobs 20, and the remaining flange standing up to a suitable height above the glass supporting plane of the table 11 to receive the straight edge of the glass piece to be beveled. During a straight edge beveling operation, the glass piece is maneuvered longitudinally along the selected straight edge guide bar 98 toward the working surface 42.

Although in the illustrated example of the apparatus the working surface bevel is shown as about 7° to the horizontal, this may be varied according to preference. A wide variety of bevel effects may be attained as to angle and width by choice of wheel working surface angle and adjustment as to depth of the beveled cut to be made in respect to any particular glass piece to be beveled.

It will be understood that variations and modifications may be effected without departing from the spirit and scope of the novel concepts of this invention.

I claim as my invention:

1. Hand fed glass beveling apparatus, comprising:

upwardly facing table means for slidably supporting a hand manipulated substantially flat glass piece to be beveled;

said table means having a substantial central solid flat glass-supporting area offset upwardly relative to a surrounding lower elevation area on which an array of spaced upwardly extending limited contact supporting projections have their upper ends in a common plane with said flat area to provide support for a glass piece which may project beyond the flat area during a beveling operation;

a rotary spindle having means at one end for rotatively selectively supporting a bevel grinding or polishing wheel having a bevel-working surface;

means for driving the spindle rotatably;

means supporting the spindle and driving means in general alignment over said flat area of the table means with said wheel-supporting end adjacent to the flat area of the table means for positioning the supported wheel with its bevel-working surface oriented to work on an edge of the glass piece slidably manipulated on said flat area of the table means toward the working surface;

and gauging stop means mounted on the table means contiguous to an edge of said flat area for stopping the glass piece edge relative to said working surface to assure proper predetermined bevel width on the glass piece being beveled.

2. Apparatus according to claim 1, wherein said glass piece supporting projections comprise an array of spaced knobs on which the glass piece rests.

3. Apparatus according to claim 2, wherein said limited solid glass supporting area edge has a recess for said gauging stop means.

4. Apparatus according to claim 1, wherein said gauging stop means comprises a rotary disk, and means rotatably mounting the disk with its edge above the glass supporting plane of the solid flat area of the table means for engagement by the glass piece edge.

5. Apparatus according to claim 4, wherein said stop disk is mounted concentrically under the wheel.

6. Apparatus according to claim 5, including a grinding or polishing wheel having a lower surface recess clearing said stop disk.

7. Apparatus according to claim 1, wherein said table means lower elevation area comprises a plurality of spaced bars, and said upward projections comprise spaced glass supporting knobs on said bars, said knobs having limited engagement surface crowns in said common plane.

8. Apparatus according to claim 1, wherein said spindle and driving means comprise parts of a vertically adjustable head, pedestal means for supporting the head above said solid flat area of the table means, and means adjustably mounting the head on the pedestal.

9. Apparatus according to claim 8, including means for effecting incremental vertical adjustments of the head relative to the pedestal means, and means for releasably locking the head in adjusted position.

10. Apparatus according to claim 8, including means for gauging incremental vertical adjustments of the head.

11. Apparatus according to claim 1, including replaceable straight edge guide means, and means on the guide means for engagement between selected ones of said upward projections for holding the guide means aligned in position relative to the wheel working surface for straight glass edge beveling and polishing.

12. Apparatus according to claim 1, including means for selectively delivering coolant water or polishing solution to the working surface of the wheel comprising a plurality of nozzles directed to deliver the coolant or solution toward a substantial chordal area of the working surface over said flat table area.

13. Apparatus according to claim 12, including a manifold receptive of the coolant or solution and supplying the nozzles substantially equally, means for supplying coolant or polishing solution to the manifold comprising selector valve means, and selectively operable coolant water supply and polishing solution supply means communicating through the valve means with said manifold.

14. Apparatus according to claim 1, including means for supplying coolant water or polishing solution selectively to said working surface, a coolant water tank under said table, a polishing solution tank under said table contiguous to said water tank, collecting means under said table to receive spent coolant water or polishing solution, and a manually operable drain spout for directing spent water from said collecting means into the water tank and for directing spent polishing solution into the polishing solution tank.

15. Apparatus according to claim 1, including means for directing coolant water or polishing solution to said working surface, a splash guard for overlying the wheel, said splash guard having a segmented depending flexible curtain extending about the wheel and permitting free manipulative movement of the glass piece under the guard toward and relative to the working surface.

16. Glass beveling apparatus including upwardly facing means for supporting a flat glass piece to be beveled, and grinding and polishing means operatively related to the supporting means, said supporting means comprising:

a plurality of upwardly extending supporting knobs;

means carrying said knobs in spaced relation to one another and with crown surfaces of the knobs in a common glass supporting plane;

and means securing said knobs to said carrying means immovably and in fixed positions relative to said carrying means.

17. Apparatus according to claim 16, wherein said knob supporting means comprise a plurality of spaced supporting bars.

18. Apparatus according to claim 16, wherein said knobs are formed from a low friction material and have limited contact crown surfaces.

19. Apparatus according to claim 4, wherein said rotary stop means disk has at least its glass engageable edge formed from a suitable elastomer.

20. Apparatus according to claim 12, wherein said lower elevation area has a pattern of slots therethrough to promote drainage.

21. Hand fed glass beveling apparatus, comprising:

table means for slidably supporting a hand manipulated substantially flat glass piece to be beveled;

a rotary spindle having means at one end for rotatively selectively supporting a bevel grinding or polishing wheel having a bevel-working surface;

means for driving the spindle rotatably;

means supporting the spindle and driving means above the table means with said wheel-supporting end adjacent to the table means for positioning the supported wheel with its bevel-working surface oriented to work on an edge of the glass piece slidably manipulated on said table means toward the working surface;

gauging stop means mounted on the table means for stopping the glass piece edge relative to said working surface;

said gauging stop means comprising a rotary disk;

and means rotatably mounting the disk with its edge above the glass supporting plane of the table means for engagement by the glass piece edge.

22. Apparatus according to claim 21, wherein said stop disk is mounted concentrically under the wheel.

23. Apparatus according to claim 22, including a grinding or polishing wheel having a lower surface recess clearing said stop disk.

24. Apparatus according to claim 21, wherein at least the glass engageable edge of said disk is formed from a suitable elastomer.

25. Hand fed glass beveling apparatus, comprising:

table means for slidably supporting a hand manipulated substantially flat glass device to be beveled;

a rotary spindle having means at one end for rotatively selectively supporting a bevel grinding or polishing wheel having a bevel-working surface;

means for driving the spindle rotatably;

means supporting the spindle and driving means above the table means with said wheel-supporting end adjacent to the table means for positioning the supported wheel with its bevel-working surface oriented to work on an edge of the glass piece slidably manipulated on said table means toward the working surface;

gauging stop means mounted on the table means for stopping the glass piece edge relative to said working surface;

means for selectively delivering coolant water or polishing solution to the working surface of the wheel comprising a plurality of nozzles directed to deliver the coolant or solution toward a substantial chordal area of the working surface;

a manifold receptive of the coolant or solution and supplying the nozzles substantially equally;

means for supplying coolant or polishing solution to the manifold comprising selector valve means, and selectively operable coolant water supply and polishing solution supply means communicating through the valve means with said manifold.

26. Apparatus according to claim 25, wherein said table means are slotted to promote drainage therethrough.

27. Hand fed glass beveling apparatus, comprising:

table means for slidably supporting a hand manipulated substantially flat glass piece to be beveled;

a rotary spindle having means at one end for rotatively selectively supporting a bevel grinding or polishing wheel having a bevel-working surface;

means for driving the spindle rotatably;

means supporting the spindle and driving means above the table means with said wheel-supporting end adjacent to the table means for positioning the supported wheel with its bevel-working surface oriented to work on an edge of the glass piece slidably manipulated on said table means toward the working surface;

gauging stop means mounted on the table means for stopping the glass piece edge relative to said working surface;

means for supplying coolant water or polishing solution selectively to said working surface;

a coolant water tank under said table;

a polishing solution tank under said table contiguous to said water tank;

collecting means under said table to receive spent coolant water or polishing solution;

and a manually operable drain spout for directing spent water from said collecting means into the water tank and for directing spent polishing solution into the polishing solution tank.

28. Apparatus according to claim 27, wherein said table has openings therethrough to promote drainage through the table, and said collecting means under the table comprise a collection pan converging downwardly toward said drain spout.

* * * * *